US011349219B2

(12) United States Patent
Toyao et al.

(10) Patent No.: US 11,349,219 B2
(45) Date of Patent: May 31, 2022

(54) MULTIBAND ANTENNA

(71) Applicant: JAPAN AVIATION ELECTRONICS INDUSTRY, LIMITED, Tokyo (JP)

(72) Inventors: Hiroshi Toyao, Tokyo (JP); Kenta Tsuchiya, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 17/123,372

(22) Filed: Dec. 16, 2020

(65) Prior Publication Data

US 2021/0265734 A1 Aug. 26, 2021

(30) Foreign Application Priority Data

Feb. 26, 2020 (JP) ..... JP2020-030284

(51) Int. Cl.

| | |
|---|---|
| ***H01Q 13/10*** | (2006.01) |
| ***H01Q 5/307*** | (2015.01) |
| *H01Q 5/314* | (2015.01) |
| *H01Q 1/24* | (2006.01) |
| *H01Q 13/16* | (2006.01) |

(52) U.S. Cl.

CPC ..... *H01Q 13/10* (2013.01); *H01Q 5/307* (2015.01); *H01Q 1/243* (2013.01); *H01Q 5/314* (2015.01); *H01Q 13/16* (2013.01)

(58) Field of Classification Search

CPC ..... H01Q 13/10; H01Q 5/307; H01Q 1/243; H01Q 5/314; H01Q 13/16

See application file for complete search history.

(56) References Cited

U.S. PATENT DOCUMENTS

| | | | |
|---|---|---|---|
| 6,847,329 | B2 | 1/2005 | Ikegaya et al. |
| 6,909,402 | B2 | 6/2005 | Vance |
| 9,166,300 | B2 | 10/2015 | Taura |
| 10,199,716 | B2 | 2/2019 | Cai et al. |

(Continued)

FOREIGN PATENT DOCUMENTS

| | | | |
|---|---|---|---|
| JP | 2004048119 | A | 2/2004 |
| JP | 2006527557 | A | 11/2006 |

(Continued)

OTHER PUBLICATIONS

Extended European Search Report (EESR) dated May 31, 2021, issued in European Application No. 20215850.7.

(Continued)

*Primary Examiner* — Joseph J Lauture

(74) *Attorney, Agent, or Firm* — Holtz, Holtz & Volek PC

(57) ABSTRACT

A multiband antenna comprises a slot antenna and a radiation element. The slot antenna has a conductive plate. The conductive plate is formed with an opening portion and a slot. The slot partially opens through the opening portion. The slot extends long in a first direction. The radiation element has a first portion and a second portion. The first portion extends from the conductive plate toward an orientation away from the slot in a second direction perpendicular to the first direction. The first portion has a first length in the second direction. The second portion extends in the first direction from the first portion. The second portion has a second length in the first direction. The second length is greater than the first length.

12 Claims, 8 Drawing Sheets

(56) References Cited

U.S. PATENT DOCUMENTS

| | | | | |
|---|---|---|---|---|
| 2007/0018892 | A1 | 1/2007 | Ku et al. | |
| 2007/0040745 | A1* | 2/2007 | Chen | H01Q 13/106 343/700 MS |
| 2009/0273524 | A1 | 11/2009 | Furuya et al. | |
| 2010/0123640 | A1 | 5/2010 | Hui et al. | |
| 2012/0162036 | A1 | 6/2012 | Yanagi et al. | |
| 2014/0049431 | A1 | 2/2014 | Tai | |
| 2015/0029068 | A1 | 1/2015 | Toyao et al. | |

FOREIGN PATENT DOCUMENTS

| | | | |
|---|---|---|---|
| JP | 2012085262 | A | 4/2012 |
| KR | 20160142892 | A | 12/2016 |
| TW | M343257 | U | 10/2008 |
| WO | 2012107976 | A1 | 8/2012 |

OTHER PUBLICATIONS

Taiwanese Office Action (and English translation thereof) dated Sep. 10, 2021, issued in counterpart Taiwanese Application No. 1091444222.

Korean Office Action (and English language translation thereof) dated Jan. 25, 2022, issued in counterpart Korean Application No. 10-2021-0003286.

* cited by examiner

MULTIBAND ANTENNA

CROSS REFERENCE TO RELATED APPLICATIONS

This application is based on and claims priority under 35 U.S.C. § 119 to Japanese Patent Application No. JP2020-030284 filed Feb. 26, 2020, the contents of which are incorporated herein in their entirety by reference.

BACKGROUND OF THE INVENTION

This invention relates to a multiband antenna comprising a radiation element.

Referring to FIG. 16, a multiband antenna 900 of JPA2012-85262 (Patent Document 1) is a so-called slot antenna. Specifically, the multiband antenna 900 has a conductive plate 910 and a stub 950. The conductive plate 910 is formed with an opening portion 912 and a slot 914. The slot 914 partially opens through the opening portion 912. The slot 914 extends long in a Y-direction. The slot 914 includes a first slot 9142 and a second slot 9146. The stub 950 is provided on the conductive plate 910 across the first slot 9142.

The multiband antenna 900 of Patent Document 1 is configured so that an adjustment of a position of the stub 950 can adjust frequencies of higher resonance modes, such as a second resonance mode, which are produced in the first slot 9142. Thus, the multiband antenna 900 of Patent Document 1 can operate at a plurality of communication frequencies.

SUMMARY OF THE INVENTION

It is therefore an object of the present invention to provide a multiband antenna which can operate at a plurality of frequencies in a manner different from Patent Document 1.

One aspect of the present invention provides a multiband antenna comprising a slot antenna and a radiation element. The slot antenna has a conductive plate. The conductive plate is formed with an opening portion and a slot. The slot partially opens through the opening portion. The slot extends long in a first direction. The radiation element has a first portion and a second portion. The first portion extends from the conductive plate toward an orientation away from the slot in a second direction perpendicular to the first direction. The first portion has a first length in the second direction. The second portion extends in the first direction from the first portion. The second portion has a second length in the first direction. The second length is greater than the first length.

The multiband antenna comprises a slot antenna and a radiation element. Accordingly, the multiband antenna of the present invention can operate at a plurality of frequencies because the multiband antenna has two resonant frequencies, namely, a resonant frequency of the slot antenna and a resonant frequency of the radiation element.

In the multiband antenna of the present invention, the slot of the slot antenna extends long in the first direction and the second portion of the radiation element extends in the first direction from the first portion. Accordingly, the slot antenna has a lowered resonant frequency. The fact that the slot antenna has the lowered resonant frequency implies that, under a specific resonant frequency, the slot of the slot antenna has a length smaller than a length of a slot of a slot antenna having no radiation element. In other words, the multiband antenna of the present invention can have a reduced size in comparison with a slot antenna having no radiation element.

An appreciation of the objectives of the present invention and a more complete understanding of its structure may be had by studying the following description of the preferred embodiment and by referring to the accompanying drawings.

Figure 1:
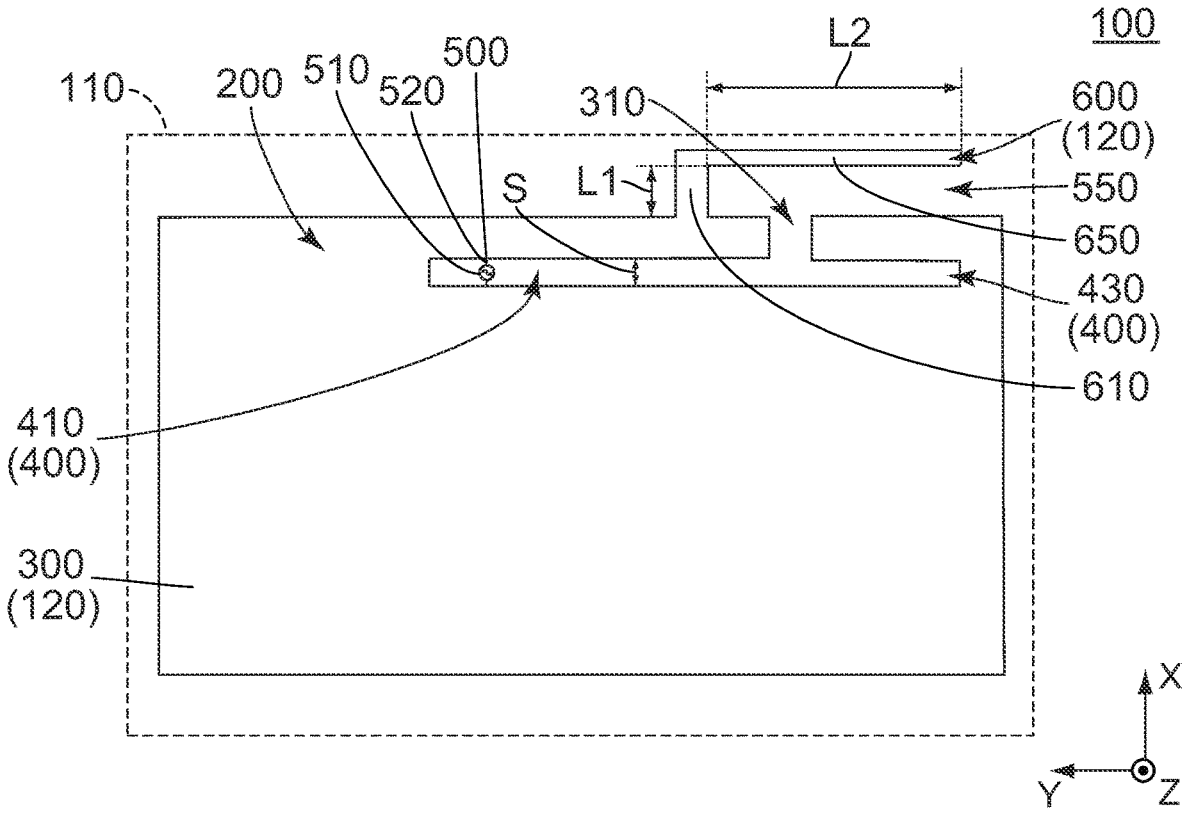
FIG. 1 is a top view showing a multiband antenna according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Referring to FIG. 1, a multiband antenna 100 according to a first embodiment of the present invention is composed of a single dielectric substrate 110 having a conductive layer 120. Specifically, the conductive layer 120 is provided on an upper surface of the dielectric substrate 110. Hereinafter, a direction perpendicular to the dielectric substrate 110 is referred to as "perpendicular direction". In the present embodiment, the perpendicular direction is a Z-direction. It is assumed that upward is a positive Z-direction while downward is a negative Z-direction.

Referring to FIG. 1, the multiband antenna 100 of the present embodiment has a plurality of operating frequencies. The multiband antenna 100 comprises a slot antenna 200 and a radiation element 600.

As shown in FIG. 1, the slot antenna 200 of the present embodiment has a conductive plate 300. The conductive plate 300 is a part of the conductive layer 120 of the dielectric substrate 110.

As shown in FIG. 1, the conductive plate 300 of the present embodiment is formed with a slot 400 and an opening portion 310.

As shown in FIG. 1, the slot 400 of the present embodiment partially opens through the opening portion 310. The slot 400 extends long in a first direction perpendicular to the perpendicular direction. In the present embodiment, the first direction is a Y-direction. In addition, the first direction is also referred to as a right-left direction. Specifically, it is assumed that rightward is a positive Y-direction while leftward is a negative Y-direction. The slot 400 has a size in a second direction perpendicular to both the perpendicular direction and the first direction, and the size of the slot 400 is not larger than one-tenth of a wavelength of any one of the operating frequencies of the multiband antenna 100. In the present embodiment, the second direction is an X-direction. In addition, the second direction is also referred to as a front-rear direction. Specifically, it is assumed that forward is a positive X-direction while rearward is a negative X-direction.

As shown in FIG. 1, the slot 400 includes a first slot 410 and a second slot 430.

As shown in FIG. 1, the first slot 410 of the present embodiment extends in the first direction, or in the right-left direction. The first slot 410 is positioned rightward of the opening portion 310 in the right-left direction.

As shown in FIG. 1, the second slot 430 of the present embodiment extends in the first direction, or in the right-left direction. The second slot 430 is positioned leftward of the opening portion 310 in the right-left direction. The first slot 410 and the second slot 430 are positioned so that the opening portion 310 is put between the first slot 410 and the second slot 430 in the first direction, or in the right-left direction.

As shown in FIG. 1, the opening portion 310 of the present embodiment opens in the second direction, or in the front-rear direction.

As shown in FIG. 1, the opening portion 310 connects the slot 400 with the outside of the conductive plate 300 in the second direction, or in the front-rear direction. The opening portion 310 is positioned between the radiation element 600 and the slot 400 in the second direction, or in the front-rear direction. The opening portion 310 is positioned rearward of the radiation element 600 in the front-rear direction. The opening portion 310 is positioned forward of the slot 400 in the front-rear direction.

As shown in FIG. 1, the radiation element 600 of the present embodiment is a part of the conductive layer 120 of the dielectric substrate 110. An electrical length of the radiation element 600 is defined with reference to one-fourth of a wavelength of one of the operating frequencies of the multiband antenna 100. In other words, the electrical length of the radiation element 600 corresponds to one-fourth of a wavelength of any one of the operating frequencies of the multiband antenna 100. The radiation element 600 has a first portion 610 and a second portion 650.

As shown in FIG. 1, the first portion 610 of the present embodiment extends from the conductive plate 300 toward an orientation away from the slot 400 in the second direction perpendicular to the first direction. In other words, the first portion 610 extends forward from the conductive plate 300 toward an orientation away from the slot 400 in the front-rear direction. The first portion 610 is nearer to the first slot 410 than to the second slot 430. The first portion 610 is positioned rightward of the opening portion 310 in the right-left direction. The first portion 610 has a first length L1 in the second direction, or in the front-rear direction.

As shown in FIG. 1, the second portion 650 of the present embodiment extends in the first direction, or in the right-left direction, from the first portion 610. More specifically, the second portion 650 extends leftward in the right-left direction from the first portion 610. The second portion 650 has a plate-like shape extending linearly in the first direction. The second portion 650 has a second length L2 in the first direction, or in the right-left direction. The second length L2 is greater than the first length L1. The opening portion 310 overlaps with the second portion 650 when the multiband antenna 100 is viewed along the second direction, or in the front-rear direction.

As shown in FIG. 1, the multiband antenna 100 has a blank 550 between the second portion 650 and the opening portion 310 in the second direction, or in the front-rear direction. The blank 550 is positioned forward of the opening portion 310 in the front-rear direction. The blank 550 is positioned rearward of the second portion 650 in the front-rear direction. The blank 550 and the opening portion 310 communicate with each other in the second direction, or in the front-rear direction. The blank 550 is positioned leftward of the first portion 610 in the right-left direction.

As shown in FIG. 1, the slot antenna 200 of the present embodiment comprises a feed point 500. The feed point 500 is positioned rightward of the opening portion 310 in the right-left direction. The feed point 500 is connected with the conductive plate 300 across the first slot 410. High frequency electrical power is supplied to the feed point 500 from a high frequency power source 510 via a feed line 520. An electrical connecting method between the feed point 500 and the feed line 520 is not particularly limited. For example, the feed line 520 may be directly connected to the feed point 500 by soldering or the like. Alternatively, the feed point 500 may be located near a part of the feed line 520 with an interval left therebetween to be connected capacitively or electromagnetically. At any rate, the feed point 500 and the feed line 520 should be electrically connected to each other so that the feed point 500 is supplied with electric power from the feed line 520.

As described above, the feed point 500 is connected with the conductive plate 300 across the first slot 410. This enables the first slot 410 to work as a feed antenna. Although the feed point 500 is not placed in close proximity to any of the second slot 430 and the radiation element 600, electrical power is indirectly supplied to any of the second slot 430 and the radiation element 600 from the feed point 500. Thus, each of the second slot 430 and the radiation element 600 works as an unpowered antenna.

Where the first embodiment of the present invention is described above, the present embodiment may be modified as follows.

First Modification

Figure 2:
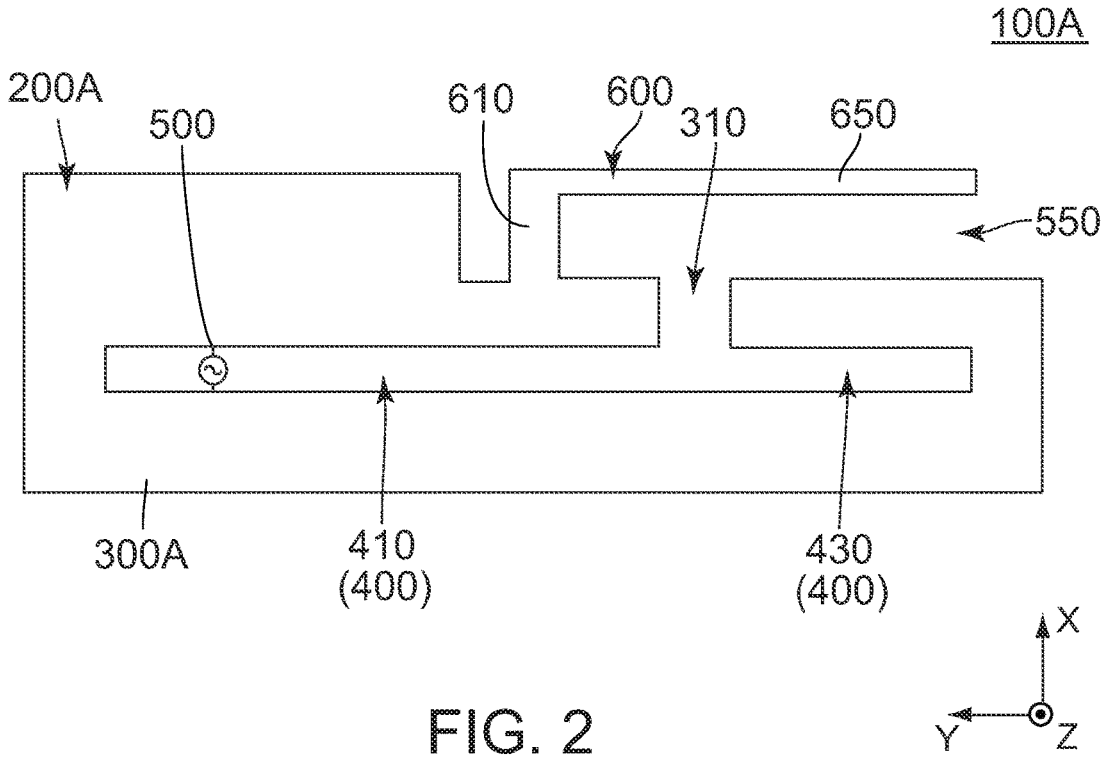
FIG. 2 is a top, schematic view showing a first modification of the multiband antenna of FIG. 1.

As shown in FIG. 2, a multiband antenna 100A according to a first modification comprises a slot antenna 200A and a radiation element 600.

As shown in FIG. 2, the slot antenna 200A of the present modification comprises a conductive plate 300A. Dissimilar to the conductive plate 300 of the aforementioned embodiment, the conductive plate 300A of the present modification extends to a location which is positioned at the same position as that of the second portion 650 of the radiation element 600 in the second direction. As compared with the conductive plate 300 of the aforementioned embodiment, the conductive plate 300A of the present modification has a conductive portion of reduced size around the first slot 410 and the second slot 430 to the extent that the multiband antenna 100A can be resonant at multiple frequencies.

Second Modification

Figure 3:
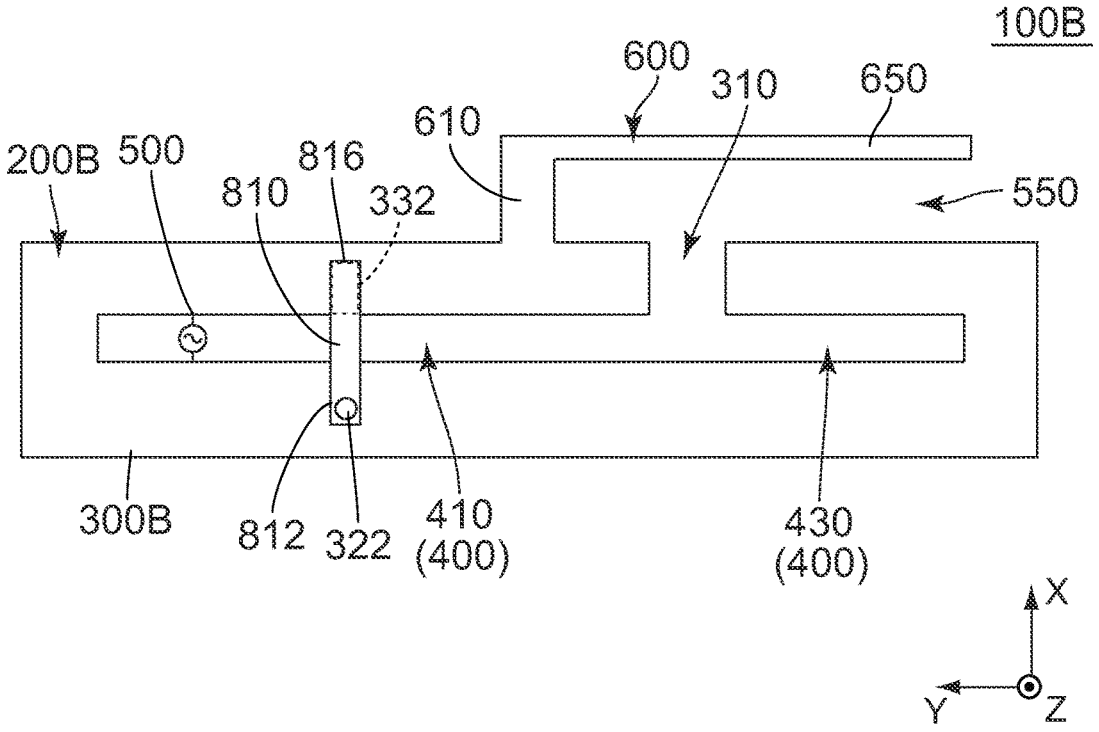
FIG. 3 is a top, schematic view showing a second modification of the multiband antenna of FIG. 1.

Referring to FIG. 3, a multiband antenna 100B according to a second modification is composed of a single dielectric substrate (not shown) having conductive layers (not shown) and a via (not shown). Specifically, the conductive layers are provided on an upper surface and a lower surface, respectively, of the dielectric substrate, and the via connects the conductive layers with each other.

As shown in FIG. 3, the multiband antenna 100B of the present modification comprises a slot antenna 200B, a radiation element 600 and a first stub 810.

As shown in FIG. 3, the slot antenna 200B of the present modification comprises a conductive plate 300B. The conductive plate 300B is a part of the conductive layer which is provided on the lower surface of the dielectric substrate. As compared with the conductive plate 300 (see FIG. 1) of the aforementioned embodiment, the conductive plate 300B has a conductive portion of reduced size around a first slot 410 and a second slot 430 to the extent that the multiband antenna 100B can be resonant at multiple frequencies.

As shown in FIG. 3, the conductive plate 300B of the present modification has a first connecting portion 322 and a first opposed portion 332.

As shown in FIG. 3, the first connecting portion 322 is positioned further away from the radiation element 600 than the first opposed portion 332 in the second direction, or in the front-rear direction. The first connecting portion 322 is positioned rearward of the first opposed portion 332 in the front-rear direction. The first connecting portion 322 and the first opposed portion 332 are positioned so that the first slot 410 is put between the first connecting portion 322 and the first opposed portion 332 in the second direction, or in the front-rear direction.

Referring to FIG. 3, the radiation element 600 of the present modification is a part of the conductive layer which is provided on the lower surface of the dielectric substrate.

Referring to FIG. 3, the first stub 810 of the present modification is a part of the conductive layer which is provided on the upper surface of the dielectric substrate. The first stub 810 is a so-called open stub. The first stub 810 corresponds to the first slot 410. In other words, the multiband antenna 1008 further comprises the first stub 810 which corresponds to the first slot 410 and which is provided across the first slot 410. The first stub 810 is positioned away from the opening portion 310 in the first direction. Specifically, the first stub 810 is positioned rightward of and away from the opening portion 310 in the right-left direction. An electrical length of the first stub 810 is less than one-fourth of a wavelength of any one of operating frequencies of the multiband antenna 100B. The first stub 810 has a plate-like shape extending in the second direction, or in the front-rear direction. However, the present invention is not limited thereto. The first stub 810 may be shaped in meander, spiral or irregularly meandering form. The first stub 810 has a first end 812 and a second end 816 in the second direction, or in the front-rear direction. The first end 812 is positioned rearward of the second end 816 in the front-rear direction. The first end 812 of the first stub 810 is connected with the first connecting portion 322. More specifically, the first end 812 of the first stub 810 is connected with the first connecting portion 322 through the via. The second end 816 of the first stub 810 is positioned away from the first opposed portion 332 and faces the first opposed portion 332. In detail, the second end 816 of the first stub 810 is positioned away from the first opposed portion 332 and faces the first opposed portion 332 in a plane which includes the second direction, or the front-rear direction. More specifically, the second end 816 of the first stub 810 is positioned away from the first opposed portion 332 and faces the first opposed portion 332 in the perpendicular direction. In other words, the second end 816 of the first stub 810 is an open end.

Referring to FIG. 3, the multiband antenna 100B of the present modification is configured so that an adjustment of a relative position of the first stub 810 with respect to the first slot 410 in the first direction, or in the right-left direction, can adjust frequencies of higher resonance modes, such as a second resonance mode, which are provided in the first slot 410. Since the first stub 810 is positioned away from the opening portion 310 in the first direction as described above, the first stub 810 has little effect on a resonant frequency of a first resonance mode which is provided in the first slot 410.

As described above, the multiband antenna 100B of the present modification is configured so that the first end 812 of the first stub 810 is connected with the first connecting portion 322 while the second end 816 of the first stub 810 is positioned away from the first opposed portion 332 and faces the first opposed portion 332. However, the present invention is not limited thereto. Specifically, the multiband antenna 100B of the present modification may be modified as follows: the first end 812 of the first stub 810 is positioned away from the first connecting portion 322 faces the first connecting portion 322; and the second end 816 of the first stub 810 is connected with the first opposed portion 332.

Third Modification

Figure 4:
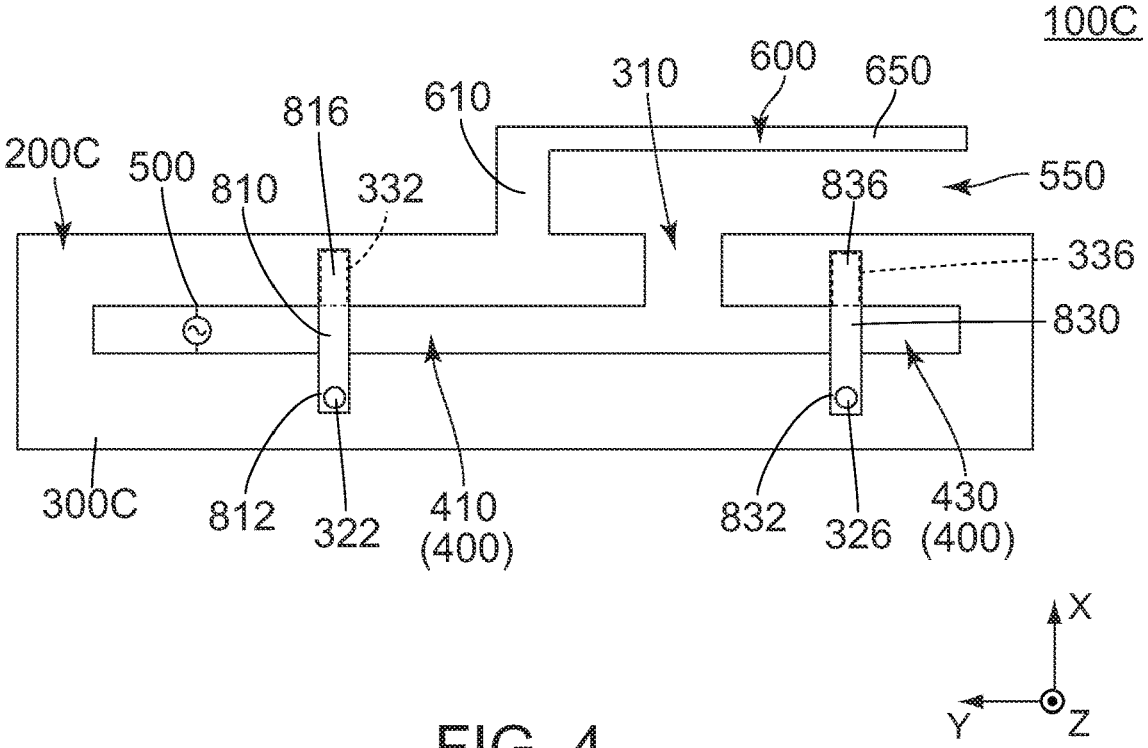
FIG. 4 is a top, schematic view showing a third modification of the multiband antenna of FIG. 1.

Referring to FIG. 4, a multiband antenna 100C according to a third modification is composed of a single dielectric substrate (not shown) having conductive layers (not shown) and vias (not shown), similar to the multiband antenna 100B of the second modification. Specifically, the conductive layers are provided on an upper surface and a lower surfaces, respectively, of the dielectric substrate. Each of the vias connects the conductive layers with each other.

As shown in FIG. 4, the multiband antenna 100C of the present modification comprises a slot antenna 200C, a radiation element 600, a first stub 810 and a second stub 830.

As shown in FIG. 4, the slot antenna 200C of the present modification has a conductive plate 300C. The conductive plate 300C is a part of the conductive layer which is provided on the lower surface of the dielectric substrate. As compared with the conductive plate 300 (see FIG. 1) of the aforementioned embodiment, the conductive plate 300C of the present modification has a conductive portion of reduced size around a first slot 410 and a second slot 430 to the extent that the multiband antenna 100C can be resonant at multiple frequencies.

As shown in FIG. 4, the conductive plate 300C of the present modification has a first connecting portion 322, a second connecting portion 326, a first opposed portion 332 and a second opposed portion 336.

As shown in FIG. 4, the second connecting portion 326 is positioned further away from the radiation element 600 than the second opposed portion 336 in the second direction, or in the front-rear direction. The second connecting portion 326 is positioned rearward of the second opposed portion 336 in the front-rear direction. The second connecting portion 326 and the second opposed portion 336 are positioned so that the second slot 430 is put between the second connecting portion 326 and the second opposed portion 336 in the second direction, or in the front-rear direction.

As shown in FIG. 4, similar to the multiband antenna 100B of the second modification, the radiation element 600 of the present modification is a part of the conductive layer which is provided on the lower surface of the dielectric substrate.

Referring to FIG. 4, the second stub 830 of the present modification is a part of the conductive layer which is provided on the upper surface of the dielectric substrate. The second stub 830 is a so-called open stub. The second stub 830 corresponds to the second slot 430. In other words, the multiband antenna 100C further comprises the second stub 830 which corresponds to the second slot 430 and which is provided across the second slot 430. The second stub 830 is positioned away from an opening portion 310 in the first direction. Specifically, the first stub 810 is positioned leftward of and away from the opening portion 310 in the right-left direction. An electrical length of the second stub 830 is less than one-fourth of a wavelength of one of operating frequencies of the multiband antenna 100C. The second stub 830 has a plate-like shape extending in the second direction, or in the front-rear direction. However, the present invention is not limited thereto. The second stub 830 may be shaped in meander, spiral or irregularly meandering form. The second stub 830 has a first end 832 and a second end 836 in the second direction, or in the front-rear direction. The first end 832 is positioned rearward of the second end 836 in the front-rear direction. The first end 832 of the second stub 830 is connected with the second connecting portion 326. More specifically, the first end 832 of the second stub 830 is connected with the second connecting portion 326 through the via. The second end 836 of the second stub 830 is positioned away from the second opposed portion 336 and faces the second opposed portion 336. In detail, the second end 836 of the second stub 830 is positioned away from the second opposed portion 336 and faces the second opposed portion 336 in the plane which includes the second direction, or the front-rear direction. More specifically, the second end 836 of the second stub 830 is positioned away from the second opposed portion 336 and faces the second opposed portion 336 in the perpendicular direction. In other words, the second end 836 of the second stub 830 is an open end.

Referring to FIG. 4, the multiband antenna 100C of the present modification is configured so that an adjustment of a relative position of the second stub 830 with respect to the second slot 430 in the first direction, or in the right-left direction, can adjust frequencies of higher resonance modes, such as a second resonance mode, which are produced in the second slot 430. Since the second stub 830 is positioned away from the opening portion 310 in the first direction as described above, the second stub 830 has little effect on a resonant frequency of a first resonance mode which is produced in the second slot 430.

As described above, the multiband antenna 100C of the present modification is configured so that the first end 832 of the second stub 830 is connected with the second connecting portion 326 while the second end 836 of the second stub 830 is positioned away from the second opposed portion 336 and faces the second opposed portion 336. However, the present invention is not limited thereto. Specifically, the multiband antenna 100C of the present modification may be modified as follows: the first end 832 of the second stub 830 is positioned away from the second connecting portion 326 and faces the second connecting portion 326; and the second end 836 of the second stub 830 is connected with the second opposed portion 336.

Fourth Modification

Figure 5:
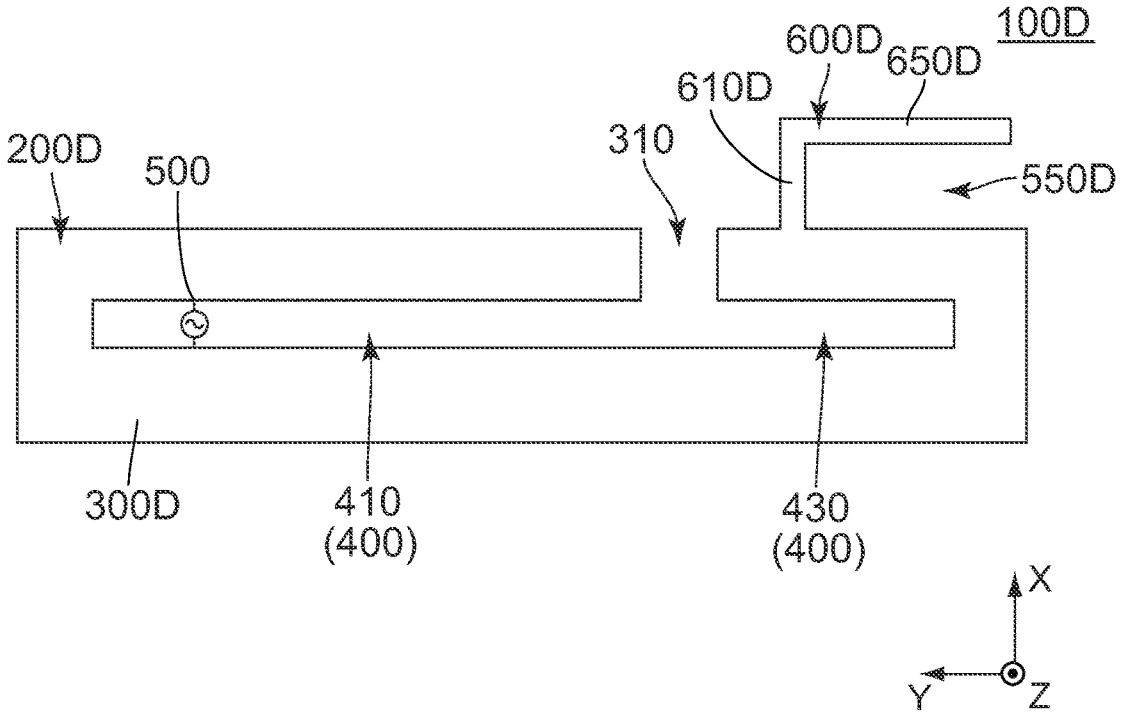
FIG. 5 is a top, schematic view showing a fourth modification of the multiband antenna of FIG. 1.

As shown in FIG. 5, a multiband antenna 100D according to a fourth modification comprises a slot antenna 200D and a radiation element 600D.

As shown in FIG. 5, the slot antenna 200D of the present modification has a conductive plate 300D. As compared with the conductive plate 300 (see FIG. 1) of the aforementioned embodiment, the conductive plate 300D has a conductive portion of reduced size around a first slot 410 and a second slot 430 to the extent that the multiband antenna 100D can be resonant at multiple frequencies.

Referring to FIG. 5, an electrical length of the radiation element 600D of the present modification is defined with reference to one-fourth of a wavelength of one of operating frequencies of the multiband antenna 100D. In other words, the electrical length of the radiation element 600D corresponds to one-fourth of a wavelength of any one of the operating frequencies of the multiband antenna 100D. The radiation element 600D has a first portion 610D and a second portion 650D.

As shown in FIG. 5, the first portion 610D of the present modification extends from the conductive plate 300D toward an orientation away from the slot 400 in the second direction perpendicular to the first direction. Specifically, the first portion 610D extends forward from the conductive plate 300D toward an orientation away from the slot 400 in the front-rear direction. The first portion 610D is nearer to the second slot 430 than to the first slot 410. The first portion 610D is positioned leftward of the opening portion 310 in the right-left direction.

As shown in FIG. 5, the second portion 650D of the present modification extends in the first direction from the first portion 610D. In other words, the second portion 650D extends in the right-left direction from the first portion 610D. More specifically, the second portion 650D extends leftward in the right-left direction from the first portion 610D. The second portion 650D has a plate-like shape extending linearly in the first direction. A second length of the second portion 650D in the first direction is greater than a first length of the first portion 610D in the second direction. The opening portion 310 does not overlap with the second portion 650D when the multiband antenna 100D is viewed along the second direction, or in the front-rear direction.

As shown in FIG. 5, the multiband antenna 100D has a blank 550D between the second portion 650D and the conductive plate 300D in the second direction, or in the front-rear direction. The blank 550D is positioned forward of the conductive plate 300D in the front-rear direction. The blank 550D is positioned rearward of the second portion 650D in the front-rear direction. The blank 550D is positioned leftward of the first portion 610D in the right-left direction.

Fifth Modification

Figure 6:
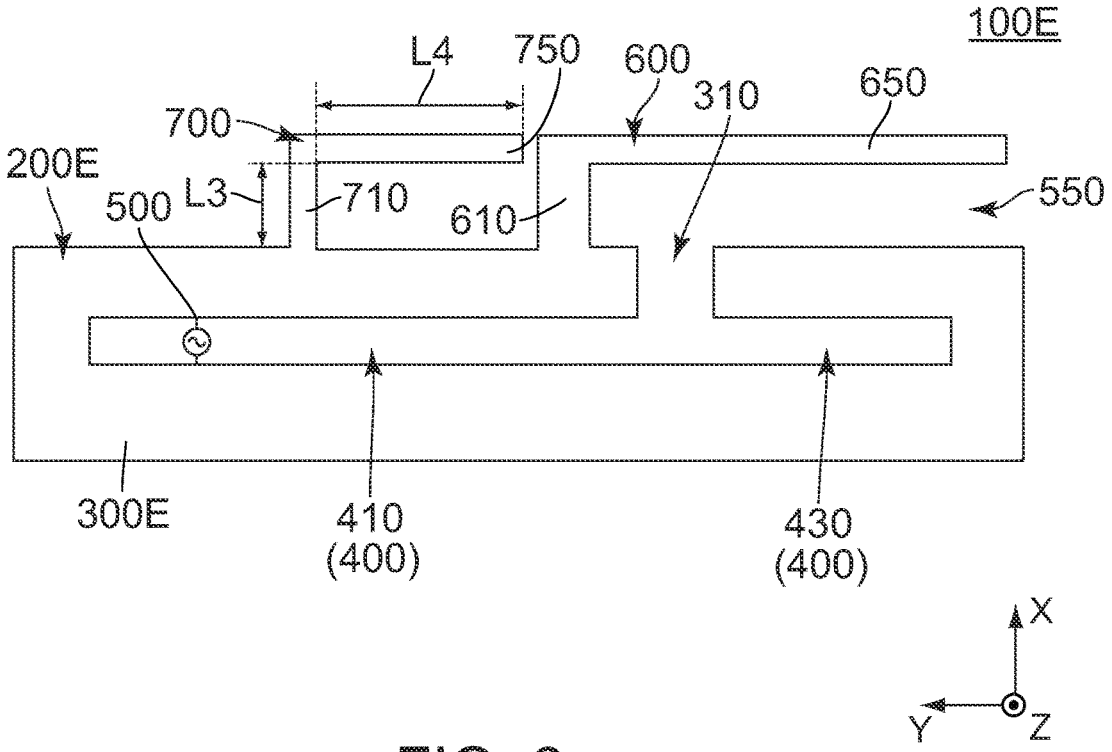
FIG. 6 is a top, schematic view showing a fifth modification of the multiband antenna of FIG. 1.

Referring to FIG. 6, a multiband antenna 100E according to a fifth modification comprises a slot antenna 200E, a radiation element 600 and an additional radiation element 700.

As shown in FIG. 6, the slot antenna 200E of the present modification comprises a conductive plate 300E. As compared with the conductive plate 300 (see FIG. 1) of the aforementioned embodiment, the conductive plate 300E of the present modification has a conductive portion of reduced size around a first slot 410 and a second slot 430 to the extent that the multiband antenna 100E can be resonant at multiple frequencies.

Referring to FIG. 6, the additional radiation element 700 of the present modification is a part of a conductive layer (not shown) of a dielectric substrate (not shown). An electrical length of the additional radiation element 700 is defined with reference to one-fourth of a wavelength of one of operating frequencies of the multiband antenna 100E. In other words, the electrical length of the additional radiation element 700 corresponds to one-fourth of a wavelength of any one of the operating frequencies of the multiband antenna 100E. The additional radiation element 700 is positioned rightward of the radiation element 600 in the right-left direction. The additional radiation element 700 has a third portion 710 and a fourth portion 750.

As shown in FIG. 6, the third portion 710 of the present modification extends from the conductive plate 300E toward an orientation away from a slot 400 in the second direction. Specifically, the third portion 710 extends forward from the conductive plate 300E toward an orientation away from the slot 400 in the front-rear direction. The third portion 710 is nearer to the first slot 410 than to the second slot 430. The third portion 710 is positioned rightward of an opening portion 310 in the right-left direction. The third portion 710 is positioned between a first portion 610 and a feed point 500 in the first direction, or in the right-left direction. The third portion 710 has a third length L3 in the second direction, or in the front-rear direction.

As shown in FIG. 6, the fourth portion 750 of the present modification extends in the first direction from the third portion 710. In other words, the fourth portion 750 extends in the right-left direction from the third portion 710. More specifically, the fourth portion 750 extends leftward in the right-left direction from the third portion 710. The fourth portion 750 has a fourth length L4 in the first direction, or in the right-left direction. The fourth length L4 is greater than the third length L3.

Sixth Modification

Figure 7:
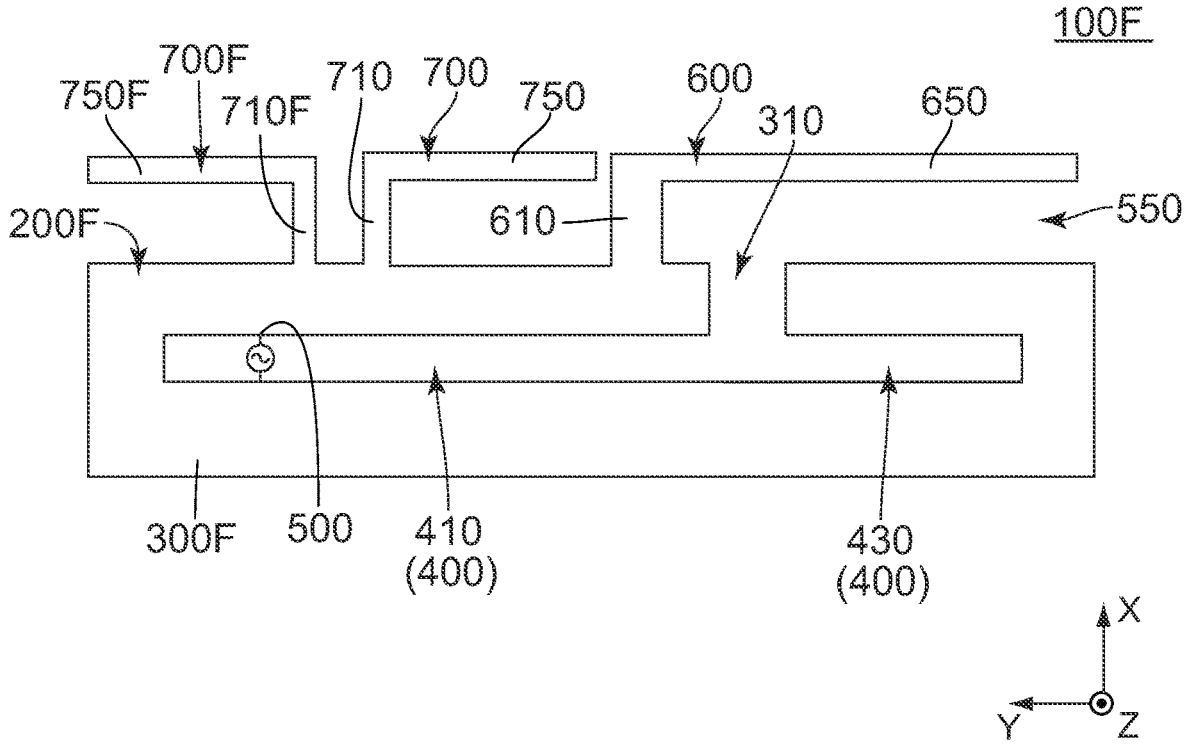
FIG. 7 is a top, schematic view showing a sixth modification of the multiband antenna of FIG. 1.

As shown in FIG. 7, a multiband antenna 100F according to a sixth modification comprises a slot antenna 200F, a radiation element 600 and two additional radiation elements 700, 700F.

As shown in FIG. 7, the slot antenna 200F of the present modification has a conductive plate 300F. As compared with the conductive plate 300 (see FIG. 1) of the aforementioned embodiment, the conductive plate 300F of the present modification has a conductive portion of reduced size around a first slot 410 and a second slot 430 to the extent that the multiband antenna 100F can be resonant at multiple frequencies.

Referring to FIG. 7, the additional radiation element 700F of the present modification is a part of a conductive layer (not shown) of a dielectric substrate (not shown). An electrical length of the additional radiation element 700F is defined with reference to one-fourth of a wavelength of one of operating frequencies of the multiband antenna 100F. In other words, the electrical length of the additional radiation element 700F corresponds to one-fourth of a wavelength of any one of the operating frequencies of the multiband antenna 100F. The additional radiation element 700F is positioned rightward of the additional radiation element 700 in the right-left direction. The additional radiation element 700F has a third portion 710F and a fourth portion 750F.

As shown in FIG. 7, the third portion 710F of the present modification extends from the conductive plate 300F toward an orientation away from a slot 400 in the second direction. Specifically, the third portion 710F extends forward from the conductive plate 300F toward an orientation away from the slot 400 in the front-rear direction. The third portion 710F is nearer to the first slot 410 than to the second slot 430. The third portion 710F is positioned rightward of an opening portion 310 in the right-left direction. The third portion 710F is positioned rightward of a third portion 710 in the right-left direction. The third portion 710F is positioned between the third portion 710 and a feed point 500 in the first direction, or in the right-left direction.

As shown in FIG. 7, the fourth portion 750F of the present modification extends in the first direction from the third portion 710F. In other words, the fourth portion 750F extends in the right-left direction from the third portion 710F. More specifically, the fourth portion 750F extends rightward in the right-left direction from the third portion 710F. A fourth length of the fourth portion 750F in the first direction is greater than a third length of the third portion 710F in the second direction.

Seventh Modification

Figure 8:
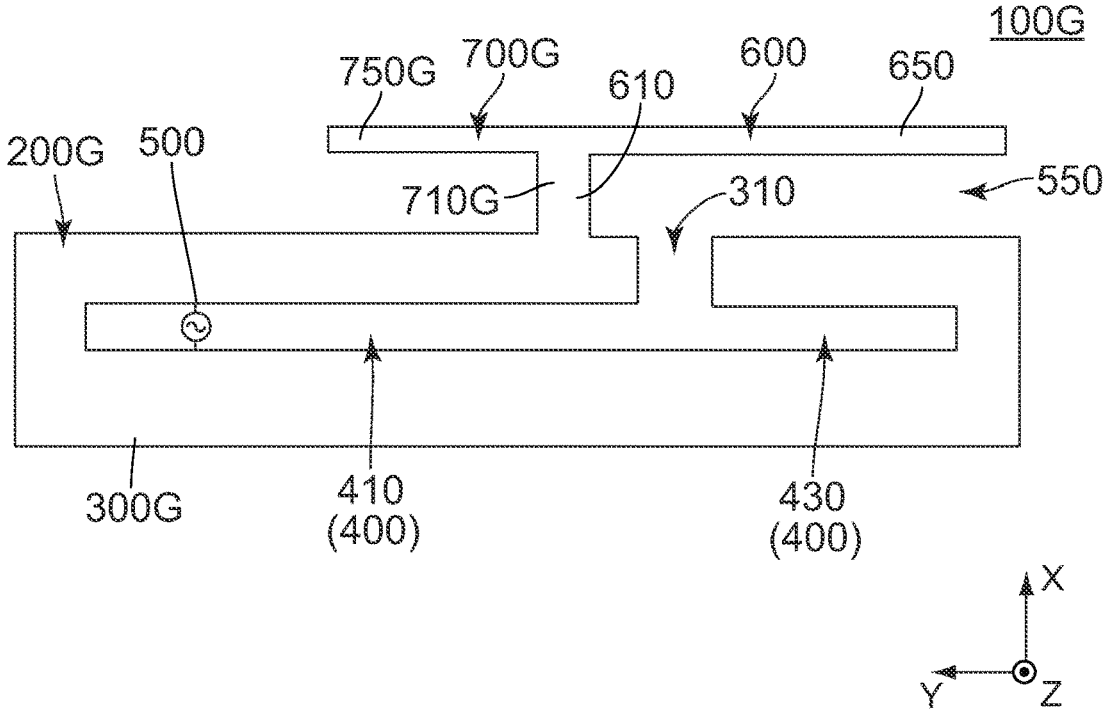
FIG. 8 is a top, schematic view showing a seventh modification of the multiband antenna of FIG. 1.

As shown in FIG. 8, a multiband antenna 100G according to a seventh modification comprises a slot antenna 200G, a radiation element 600 and an additional radiation element 700G.

As shown in FIG. 8, the slot antenna 200G of the present modification has a conductive plate 300G. As compared with the conductive plate 300 (see FIG. 1) of the aforementioned embodiment, the conductive plate 300G of the present modification has a conductive portion of reduced size around a first slot 410 and a second slot 430 to the extent that the multiband antenna 100G can be resonant at multiple frequencies.

Referring to FIG. 8, the additional radiation element 700G of the present modification is a part of a conductive layer (not shown) of a dielectric substrate (not shown). An electrical length of the additional radiation element 700G is defined with reference to one-fourth of a wavelength of one of operating frequencies of the multiband antenna 100G. In other words, the electrical length of the additional radiation element 700G corresponds to one-fourth of a wavelength of any one of the operating frequencies of the multiband antenna 100G. The additional radiation element 700G is positioned rightward of the radiation element 600 in the right-left direction. The additional radiation element 700G has a third portion 710G and a fourth portion 750G.

As shown in FIG. 8, the third portion 710G of the present modification extends from the conductive plate 300G toward an orientation away from a slot 400 in the second direction. Specifically, the third portion 710G extends forward from the conductive plate 300G toward an orientation away from the slot 400 in the front-rear direction. The third portion 710G is nearer to the first slot 410 than to the second slot 430. The third portion 710G is positioned rightward of an opening portion 310 in the right-left direction. The third portion 710G is common with a first portion 610.

As shown in FIG. 8, the fourth portion 750G of the present modification extends in the first direction from the third portion 710G. In other words, the fourth portion 750G extends in the right-left direction from the third portion 710G. More specifically, the fourth portion 750G extends rightward in the right-left direction from the third portion 710G. A fourth length of the fourth portion 750G in the first direction is greater than a third length of the third portion 710G in the second direction.

Eighth Modification

Figure 9:
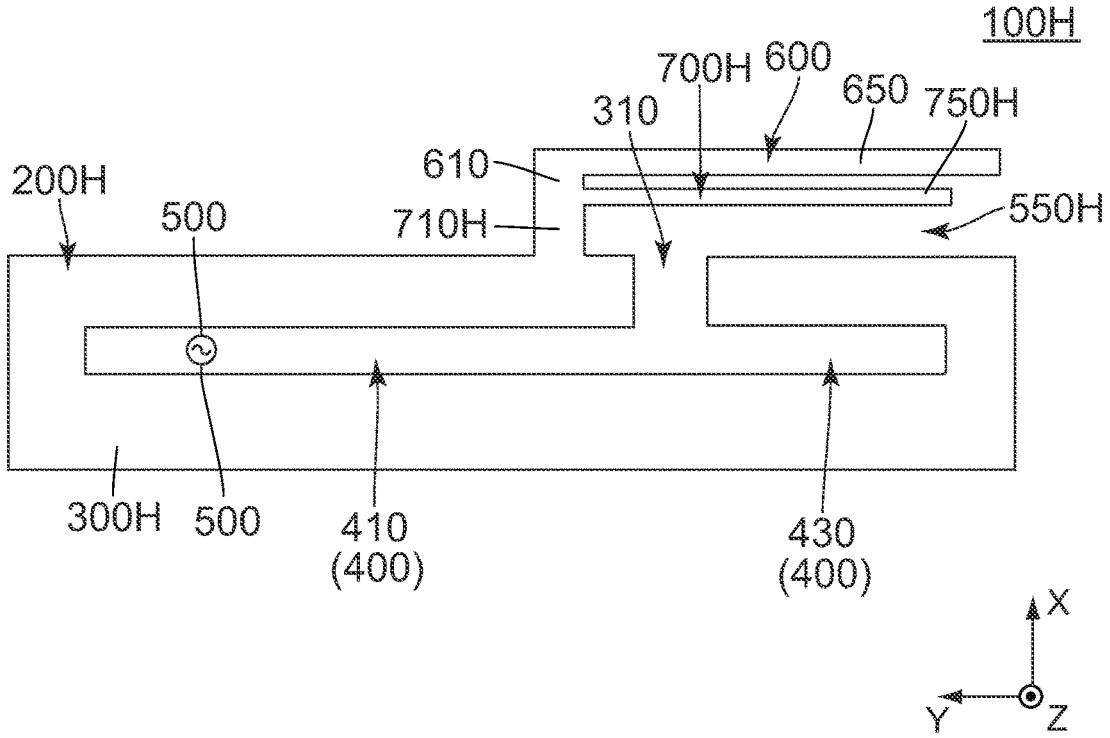
FIG. 9 is a top, schematic view showing an eighth modification of the multiband antenna of FIG. 1.

As shown in FIG. 9, a multiband antenna 100H according to an eighth modification comprises a slot antenna 200H, a radiation element 600 and an additional radiation element 700H.

As shown in FIG. 9, the slot antenna 200H of the present modification has a conductive plate 300H. As compared with the conductive plate 300 (see FIG. 1) of the aforementioned embodiment, the conductive plate 300H of the present modification has a conductive portion of reduced size around a first slot 410 and a second slot 430 to the extent that the multiband antenna 100H can be resonant at multiple frequencies.

Referring to FIG. 9, the additional radiation element 700H of the present modification is a part of a conductive layer (not shown) of a dielectric substrate (not shown). An electrical length of the additional radiation element 700H is defined with reference to one-fourth of a wavelength of one of operating frequencies of the multiband antenna 100H. In other words, the electrical length of the additional radiation element 700H corresponds to one-fourth of a wavelength of any one of the operating frequencies of the multiband antenna 100H. The additional radiation element 700H has a third portion 710H and a fourth portion 750H.

As shown in FIG. 9, the third portion 710H of the present modification extends from the conductive plate 300H toward an orientation away from a slot 400 in the second direction. Specifically, the third portion 710H extends forward from the conductive plate 300H toward an orientation away from the slot 400 in the front-rear direction. The third portion 710H is nearer to the first slot 410 than to the second slot 430. The third portion 710H is positioned rightward of an opening portion 310 in the right-left direction. The third portion 710H is common with a part of a first portion 610.

As shown in FIG. 9, the fourth portion 750H of the present modification extends in the first direction from the third portion 710H. In other words, the fourth portion 750H extends in the right-left direction from the third portion 710H. More specifically, the fourth portion 750H extends leftward in the right-left direction from the third portion 710H. A fourth length of the fourth portion 750H in the first direction is greater than a third length of the third portion 710H in the second direction. The opening portion 310 overlaps with the fourth portion 750H when the multiband antenna 100H is viewed along the second direction. In other words, the opening portion 310 overlaps with the fourth portion 750H when the multiband antenna 100H is viewed along the front-rear direction.

As shown in FIG. 9, the multiband antenna 100H has a blank 550H between the fourth portion 750H and the conductive plate 300H in the second direction, or in the front-rear direction. The blank 550H is positioned forward of the conductive plate 300H in the front-rear direction. The blank 550H is positioned rearward of the fourth portion 750H in the front-rear direction. The blank 550H is positioned leftward of the third portion 710H in the right-left direction.

Referring to FIGS. 1 to 9, as compared with the conductive plate 300 of the aforementioned embodiment, the conductive plate 300A, 300B, 300C, 300D, 300E, 300F, 300G, 300H of the aforementioned modification has the conductive portion of reduced size around the first slot 410 and the second slot 430 to the extent that the multiband antenna 100A, 1008, 100C, 100D, 100E, 100F, 100G, 100H can be resonant at the multiple frequencies. However, the present invention is not limited thereto. Specifically, the conductive plate 300A, 300B, 300C, 300D, 300E, 300F, 300G, 300H may have a conductive portion of increased size around the first slot 410 and the second slot 430 similar to the conductive plate 300 of the aforementioned embodiment.

Referring to FIGS. 1 to 9, each of the multiband antenna 100, 100A, 1008, 100C, 100D, 100E, 100F, 100G, 100H of the aforementioned embodiment and modifications has no stub that is positioned leftward of the opening portion 310 across the blank 550, 550D, 550H. However, the present invention is not limited thereto. Specifically, the multiband antenna 100, 100A, 1008, 100C, 100D, 100E, 100F, 100G, 100H may have a stub that is positioned leftward of the opening portion 310 across the blank 550, 550D, 550H.

Second Embodiment

Figure 10:
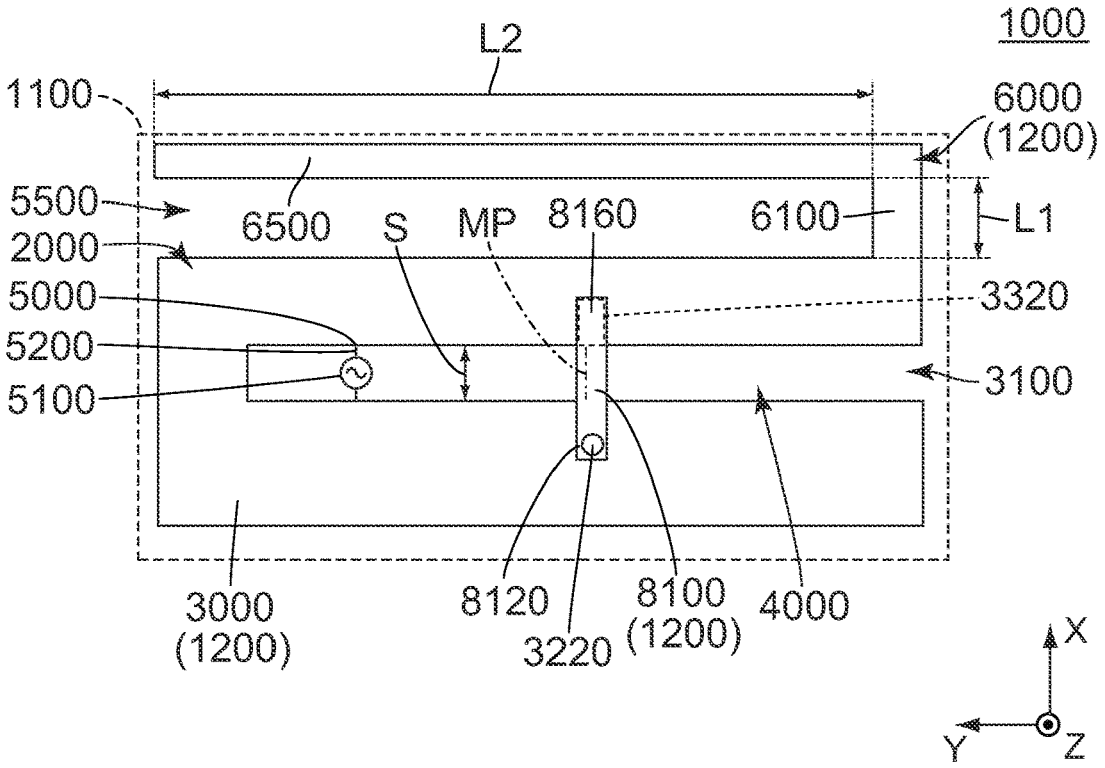
FIG. 10 is a top view showing a multiband antenna according to a second embodiment of the present invention. In the figure, a capacitive layer and vias are omitted.

Referring to FIG. 10, a multiband antenna 1000 according to a second embodiment of the present invention is composed of a single dielectric substrate 1100 having conductive layers 1200 and a via (not shown). Specifically, the conductive layers 1200 are provided on an upper surface and a lower surface of the dielectric substrate 1100, and the via connects the conductive layers 1200 with each other.

Referring to FIG. 10, the multiband antenna 1000 has a plurality of operating frequencies. The multiband antenna 1000 comprises a slot antenna 2000 and a radiation element 6000. As for directions and orientations in the present embodiment, expressions same as those of the first embodiment will be used hereinbelow.

As shown in FIG. 10, the slot antenna 2000 of the present embodiment has a conductive plate 3000. The conductive plate 3000 is a part of the conductive layer 1200 which is provided on the lower surface of the dielectric substrate 1100. As compared with the conductive plate 300 of the first embodiment, the conductive plate 3000 of the present embodiment has a conductive portion of reduced size around a slot 4000 to the extent that the multiband antenna 1000 can be resonant at multiple frequencies.

As shown in FIG. 10, the conductive plate 3000 of the present embodiment has a first connecting portion 3220, or a connecting portion 3220, and a first opposed portion 3320, or an opposed portion 3320.

As shown in FIG. 10, the first connecting portion 3220 of the present embodiment is positioned further away from the radiation element 6000 than the first opposed portion 3320 in the second direction, or in the front-rear direction. The first connecting portion 3220 is positioned rearward of the first opposed portion 3320 in the front-rear direction. The first connecting portion 3220 and the first opposed portion 3320 are positioned so that the slot 4000 is put between the first connecting portion 3220 and the first opposed portion 3320 in the second direction, or in the front-rear direction.

As shown in FIG. 10, the conductive plate 3000 of the present embodiment is formed with the slot 4000 and an opening portion 3100.

As shown in FIG. 10, the slot 4000 of the present embodiment partially opens through the opening portion 3100. The slot 4000 extends long in the first direction, or in the right-left direction. A size S of the slot 4000 in the second direction is not larger than one-tenth of a wavelength of any one of the operating frequencies.

As shown in FIG. 10, the opening portion 3100 of the present embodiment opens in the first direction. Specifically, the opening portion 310 opens leftward in the right-left direction.

As shown in FIG. 10, the opening portion 3100 connects the slot 4000 with the outside of the conductive plate 3000 in the first direction, or in the right-left direction. The opening portion 3100 is positioned rearward of the radiation element 6000 in the front-rear direction. The opening portion 310 is positioned at a left end of the slot 400 in the right-left direction.

Referring to FIG. 10, the radiation element 6000 of the present embodiment is a part of the conductive layer 1200 which is provided on the lower surface of the dielectric substrate 1100. An electrical length of the radiation element 6000 is defined with reference to one-fourth of a wavelength of one of the operating frequencies of the multiband antenna 1000. In other words, the electrical length of the radiation element 6000 corresponds to one-fourth of a wavelength of any one of the operating frequencies of the multiband antenna 1000. The radiation element 6000 has a first portion 6100 and a second portion 6500.

As shown in FIG. 10, the first portion 6100 of the present embodiment extends from the conductive plate 3000 toward an orientation away from the slot 4000 in the second direction perpendicular to the first direction. Specifically, the first portion 6100 extends forward from the conductive plate 3000 toward an orientation away from the slot 4000 in the front-rear direction. The first portion 6100 has a first length L1 in the second direction, or in the front-rear direction. The first portion 6100 is nearer to the opening portion 3100 than to a midpoint MP of the slot 4000 in the first direction. More specifically, the first portion 6100 is positioned in the vicinity of the opening portion 3100 in the first direction, or in the right-left direction.

As shown in FIG. 10, the second portion 6500 of the present embodiment extends in the first direction from the first portion 6100. In other words, the second portion 6500 extends in the right-left direction from the first portion 6100. In detail, the second portion 6500 extends rightward in the right-left direction from the first portion 6100. The second portion 6500 has a plate-like shape extending linearly in the first direction. The second portion 6500 has a second length L2 in the first direction, or in the right-left direction. The second length L2 is greater than the first length L1.

As shown in FIG. 10, the multiband antenna 1000 has a blank 5500 between the second portion 6500 and the conductive plate 3000 in the second direction, or in the front-rear direction. The blank 5500 is positioned forward of the conductive plate 3000 in the front-rear direction. The blank 5500 is positioned rearward of the second portion 6500 in the front-rear direction. The blank 5500 is positioned rightward of the first portion 6100 in the right-left direction.

As shown in FIG. 10, the slot antenna 2000 of the present embodiment comprises a feed point 5000. The feed point 5000 is positioned rightward of the midpoint MP in the right-left direction. The feed point 500 is connected with the conductive plate 3000 across the slot 4000. High frequency electrical power is supplied to the feed point 5000 from a high frequency power source 5100 via a feed line 5200. An electrical connecting method between the feed point 5000 and the feed line 5200 is not particularly limited. For example, the feed line 5200 may be directly connected to the feed point 5000 by soldering or other methods. Alternatively, the feed point 5000 may be located near a part of the feed line 5200 with an interval left therebetween to be connected capacitively or electromagnetically. At any rate, the feed point 5000 and the feed line 5200 should be electrically connected to each other so that the feed point 5000 is supplied with electric power from the feed line 5200.

As described above, the feed point 5000 is connected with the conductive plate 3000 across the slot 4000. This enables the slot 4000 to work as a feed antenna. Although the feed point 5000 is not placed in close proximity to the radiation element 6000, electrical power is indirectly supplied to the radiation element 6000 from the feed point 5000. Thus, the radiation element 6000 works as an unpowered antenna.

As shown in FIG. 10, the multiband antenna 1000 of the present embodiment further comprises a stub 8100.

Referring to FIG. 10, the stub 8100 of the present embodiment is a part of the conductive layer 1200 which is provided on the upper surface of the dielectric substrate 1100. The stub 8100 is a so-called open stub. The stub 8100 corresponds to the slot 4000. In other words, the multiband antenna 1000 further comprises the stub 8100 which corresponds to the slot 4000 and which is provided across the slot 4000. The stub 8100 is positioned away from the opening portion 3100 in the first direction. Specifically, the stub 8100 is positioned rightward of and away from the opening portion 3100 in the right-left direction. An electrical length of the stub 8100 is less than one-fourth of a wavelength of one of the operating frequencies of the multiband antenna 1000. The stub 8100 has a plate-like shape extending in the second direction, or in the front-rear direction. However, the present invention is not limited thereto. The stub 8100 may be shaped in meander, spiral or irregularly meandering form. The stub 8100 has a first end 8120 and a second end 8160 in the second direction, or in the front-rear direction. The first end 8120 is positioned rearward of the second end 8160 in the front-rear direction. The first end 8120 of the stub 8100 is connected with the first connecting portion 3220, or with the connecting portion 3220. More specifically, the first end 8120 of the stub 8100 is connected with the first connecting portion 3220 through the via. The second end 8160 of the stub 8100 is positioned away from the first opposed portion 3320, or from the opposed portion 3320, and faces the first opposed portion 3320, or the opposed portion 3320. In detail, the second end 8160 of the stub 8100 is positioned away from the first opposed portion 3320 and faces the first opposed portion 3320 in a plane which includes the second direction, or the front-rear direction. More specifically, the second end 8160 of the stub 8100 is positioned away from the first opposed portion 3320 and faces the first opposed portion 3320 in the perpendicular direction. In other words, the second end 8160 of the stub 8100 is an open end.

Referring to FIG. 10, the multiband antenna 1000 of the present embodiment is configured so that an adjustment of a relative position of the stub 8100 with respect to the slot 4000 in the first direction, or in the right-left direction, can adjust frequencies of higher resonance modes, such as a second resonance mode, which are produced in the slot 4000. Since the stub 8100 is positioned away from the opening portion 3100 in the first direction as described above, the stub 8100 has little effect on a resonant frequency of a first resonance mode which is produced in the slot 4000.

As described above, the multiband antenna 1000 of the present embodiment is configured so that the first end 8120 of the stub 8100 is connected with the first connecting portion 3220 while the second end 8160 of the stub 8100 is positioned away from the first opposed portion 3320 and faces the first opposed portion 3320. However, the present invention is not limited thereto. Specifically, the multiband antenna 1000 of the present embodiment may be modified as follows: the first end 8120 of the stub 8100 is positioned away from the first connecting portion 3220 and faces the first connecting portion 3220; and the second end 8160 of the stub 8100 is connected with the first opposed portion 3320.

Where the second embodiment of the present invention is described above, the present embodiment may be modified as follows.

First Modification

Figure 11:
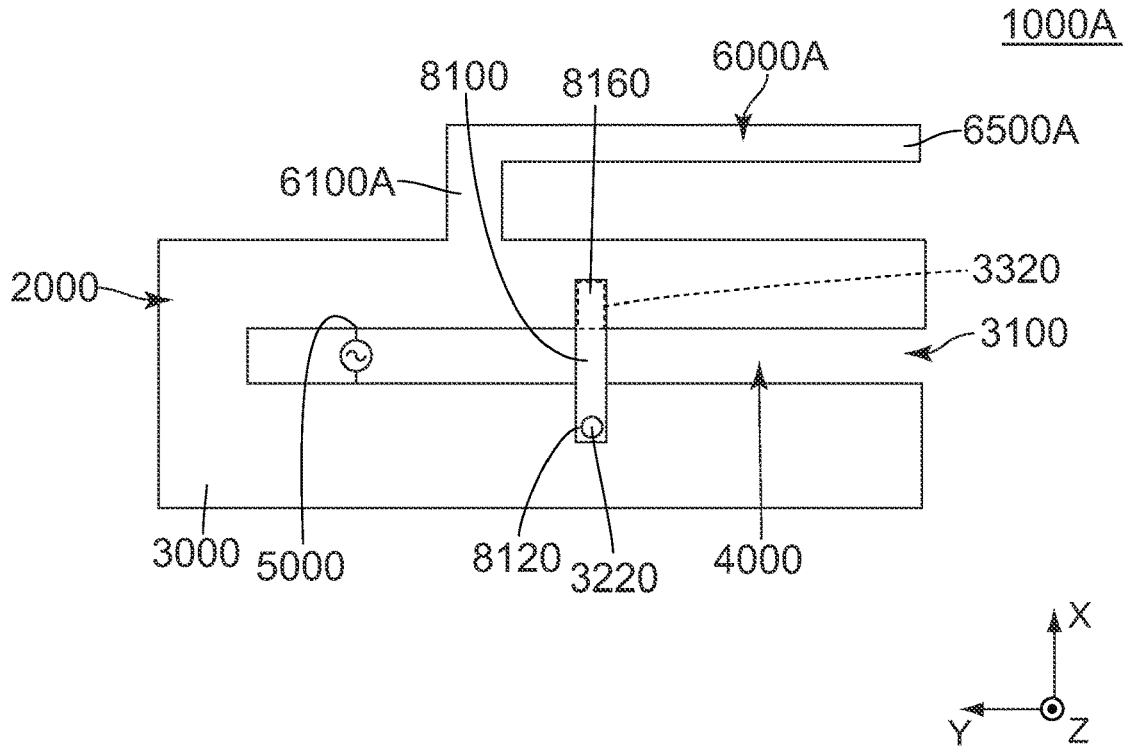
FIG. 11 is a top, schematic view showing a first modification of the multiband antenna of FIG. 10.

As shown in FIG. 11, a multiband antenna 1000A according to a first modification comprises a slot antenna 2000, a radiation element 6000A and a stub 8100.

Referring to FIG. 11, the radiation element 6000A of the present modification is a part of a conductive layer (not shown) which is provided on a lower surface of a dielectric substrate (not shown). An electrical length of the radiation element 6000A is defined with reference to one-fourth of a wavelength of one of operating frequencies of the multiband antenna 1000A. In other words, the electrical length of the radiation element 6000A corresponds to one-fourth of a wavelength of any one of the operating frequencies of the multiband antenna 1000A. The radiation element 6000A has a first portion 6100A and a second portion 6500A.

As shown in FIG. 11, the first portion 6100A of the present modification extends from a conductive plate 3000 toward an orientation away from a slot 4000 in the second direction perpendicular to the first direction. Specifically, the first portion 6100A extends forward from the conductive plate 3000 toward an orientation away from the slot 4000 in the front-rear direction. The first portion 6100A is positioned between a feed point 5000 and the stub 8100 in the first direction, or in the right-left direction.

As shown in FIG. 11, the second portion 6500A of the present modification extends in the first direction from the first portion 6100A. In other words, the second portion 6500A extends in the right-left direction from the first portion 6100A. More specifically, the second portion 6500A extends leftward in the right-left direction from the first portion 6100A. The second portion 6500A has a plate-like shape extending linearly in the first direction. A second length of the second portion 6500A in the first direction is greater than a first length of the first portion 6100A in the second direction.

Second Modification

Figure 12:
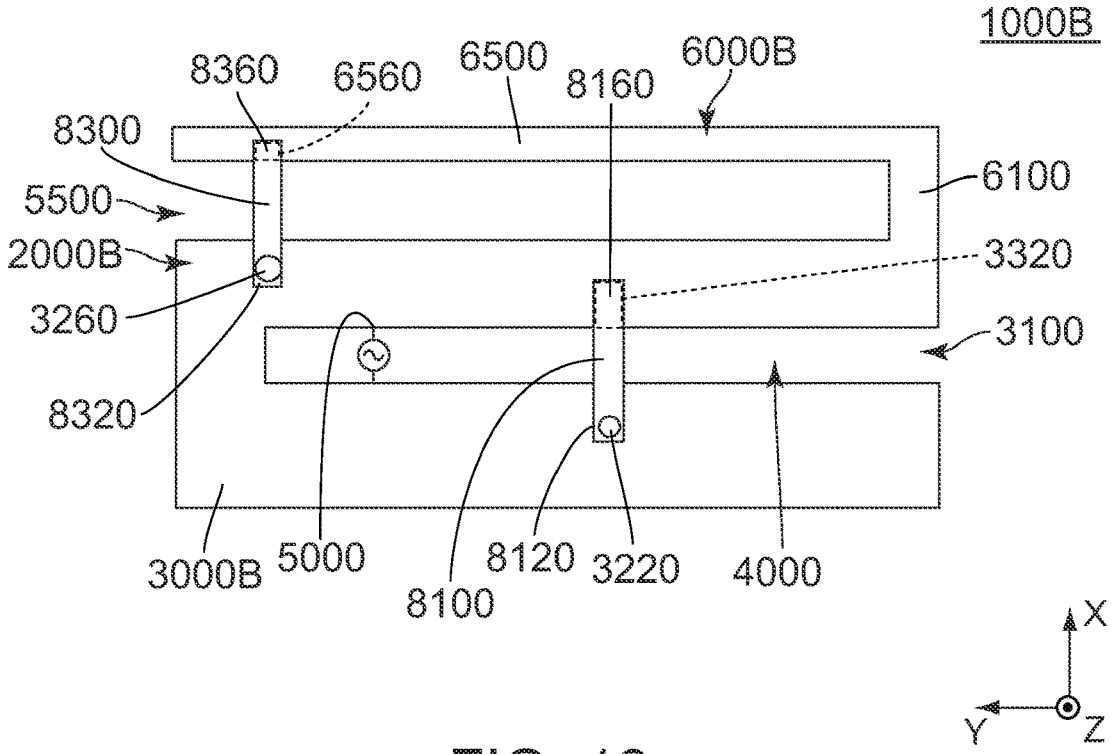
FIG. 12 is a top, schematic view showing a second modification of the multiband antenna of FIG. 10.

As shown in FIG. 12, a multiband antenna 1000B according to a second modification comprises a slot antenna 2000B, a radiation element 6000B, a first stub 8100, or a stub 8100, and a second stub 8300.

As shown in FIG. 12, the slot antenna 2000B of the present modification has a conductive plate 3000B. The conductive plate 300B is a part of a conductive layer (not shown) which is provided on a lower surface of a dielectric substrate (not shown). Similar to the conductive plate 3000 of the aforementioned embodiment, the conductive plate 3000B of the present modification has a conductive portion of reduced size around a slot 4000 to the extent that the multiband antenna 1000B can be resonant at multiple frequencies.

As shown in FIG. 12, the conductive plate 3000B of the present modification has a first connecting portion 3220, a second connecting portion 3260 and a first opposed portion 3320. The first connecting portion 3220 and the first opposed portion 3320 are positioned so that the slot 4000 is put between the first connecting portion 3220 and the first opposed portion 3320 in the second direction, or in the front-rear direction.

Referring to FIG. 12, the radiation element 6000B of the present modification is a part of the conductive layer (not shown) which is provided on the lower surface of the dielectric substrate (not shown). The radiation element 6000B has a second opposed portion 6560. The second opposed portion 6560 is positioned around a right end of the radiation element 6000B in the right-left direction. The second connecting portion 3260 and the second opposed portion 6560 are positioned so that a blank 5500 is put between the second connecting portion 3260 and the second opposed portion 6560 in the second direction, or in the front-rear direction.

Referring to FIG. 12, the second stub 8300 of the present modification is a part of a conductive layer (not shown) which is provided on an upper surface of the dielectric substrate (not shown). The second stub 8300 is a so-called open stub. The second stub 8300 corresponds to the blank 5500. In other words, the multiband antenna 1000B further comprises the second stub 8300 which corresponds to the blank 5500 and which is provided across the blank 5500. An electrical length of the second stub 8300 is less than one-fourth of a wavelength of one of operating frequencies of the multiband antenna 1000B. The second stub 8300 has a plate-like shape extending in the second direction, or in the front-rear direction. However, the present invention is not limited thereto. The second stub 8300 may be shaped in meander, spiral or irregularly meandering form. The second stub 8300 has a first end 8320 and the second end 8360 in the second direction, or in the front-rear direction. The first end 8320 is positioned rearward of the second end 8360 in the front-rear direction. The first end 8320 of the second stub 8300 is connected with the second connecting portion 3260. More specifically, the first end 8320 of the second stub 8300 is connected with the second connecting portion 3260 through a via. The second end 8360 of the second stub 8300 is positioned away from the second opposed portion 6560 and faces the second opposed portion 6560. In detail, the second end 8360 of the second stub 8300 is positioned away from the second opposed portion 6560 and faces the second opposed portion 6560 in a plane which includes the second direction, or the front-rear direction. More specifically, the second end 8360 of the second stub 8300 is positioned away from the second opposed portion 6560 and faces the second opposed portion 6560 in the perpendicular direction. In other words, the second end 8360 of the second stub 8300 is an open end.

As described above, the multiband antenna 1000B of the present modification is configured so that the first end 8320 of the second stub 8300 is connected with the second connecting portion 3260 while the second end 8360 of the second stub 8300 is positioned away from the second opposed portion 6560 and faces the second opposed portion 6560. However, the present invention is not limited thereto. Specifically, the multiband antenna 1000B of the present modification may be modified as follows: the first end 8320 of the second stub 8300 is positioned away from the second connecting portion 3260 and faces the second connecting portion 3260; and the second end 8360 of the second stub 8300 is connected with the second opposed portion 6560.

Third Modification

Figure 13:
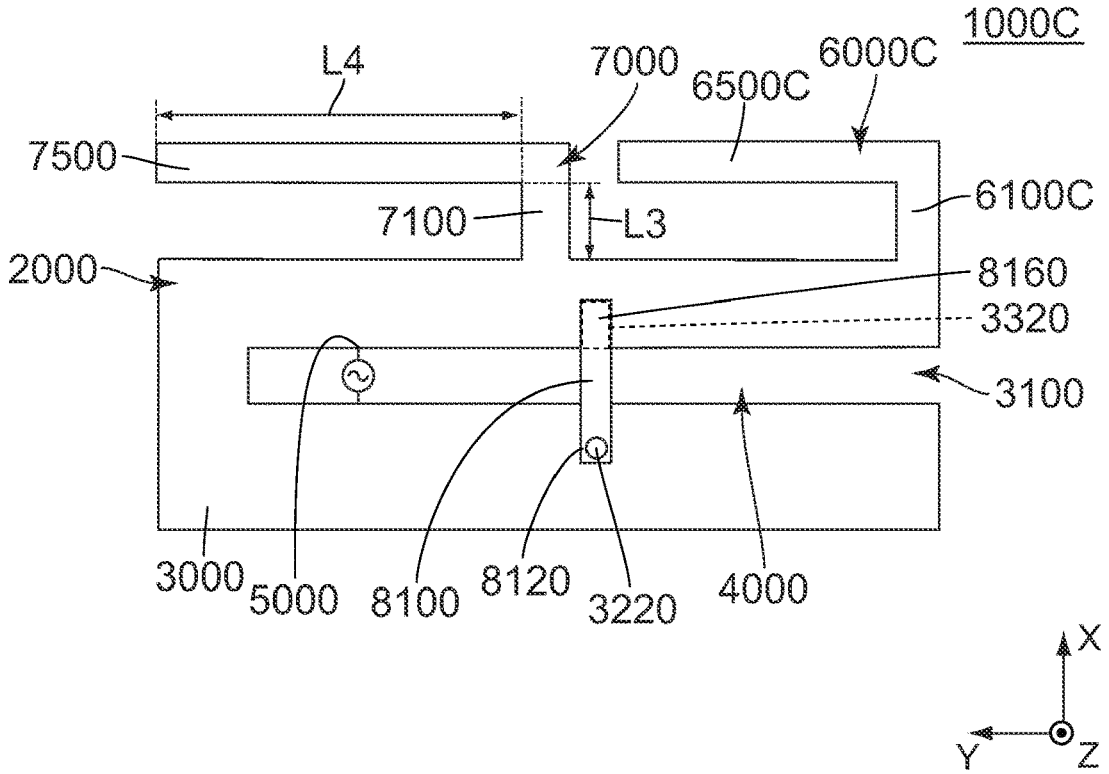
FIG. 13 is a top, schematic view showing a third modification of the multiband antenna of FIG. 10.

As shown in FIG. 13, a multiband antenna 1000C according to a third modification comprises a slot antenna 2000, a radiation element 6000C, a stub 8100, and an additional radiation element 7000.

Referring to FIG. 13, the radiation element 6000C of the present modification is a part of a conductive layer (not shown) which is provided on a lower surface of a dielectric substrate (not shown). An electrical length of the radiation element 6000C is defined with reference to one-fourth of a wavelength of one of operating frequencies of the multiband antenna 1000C. In other words, the electrical length of the radiation element 6000C corresponds to one-fourth of a wavelength of any one of the operating frequencies of the multiband antenna 1000C. The radiation element 6000C is positioned leftward of the additional radiation element 7000 in the right-left direction. The radiation element 6000C is positioned leftward of the stub 8100 in the right-left direction. The radiation element 6000C has a first portion 6100C and a second portion 6500C.

As shown in FIG. 13, the first portion 6100C of the present modification extends from a conductive plate 3000 toward an orientation away from a slot 4000 in the second direction perpendicular to the first direction. Specifically, the first portion 6100C extends forward from the conductive plate 3000 toward an orientation away from the slot 4000 in the front-rear direction. The first portion 6100C is nearer to an opening portion 3100 than to a midpoint of the slot 4000 in the first direction. More specifically, the first portion 6100C is positioned in the vicinity of the opening portion 3100 in the first direction, or in the right-left direction.

As shown in FIG. 13, the second portion 6500C of the present modification extends in the first direction from the first portion 6100C. In other words, the second portion 6500C extends in the right-left direction from the first portion 6100C. In detail, the second portion 6500C extends rightward in the right-left direction from the first portion 6100C. The second portion 6500C has a plate-like shape extending linearly in the first direction. A second length of the second portion 6500C in the first direction is greater than a first length of the first portion 6100C in the second direction.

Referring to FIG. 13, the additional radiation element 7000 of the present modification is a part of the conductive layer (not shown) which is provided on the lower surface of the dielectric substrate (not shown). An electrical length of the additional radiation element 7000 is defined with reference to one-fourth of a wavelength of one of operating frequencies of the multiband antenna 1000C. In other words, the electrical length of the additional radiation element 7000 corresponds to one-fourth of a wavelength of any one of the operating frequencies of the multiband antenna 1000C. The additional radiation element 7000 is positioned rightward of the radiation element 6000C in the right-left direction. The additional radiation element 7000 is positioned rightward of the stub 8100 in the right-left direction. The additional radiation element 7000 has a third portion 7100 and a fourth portion 7500.

As shown in FIG. 13, the third portion 7100 of the present modification extends from the conductive plate 3000 toward an orientation away from the slot 4000 in the second direction. Specifically, the third portion 7100 extends forward from the conductive plate 3000 toward an orientation away from the slot 4000 in the front-rear direction. The third portion 7100 has a third length L3 in the second direction.

As shown in FIG. 13, the fourth portion 7500 of the present modification extends in the first direction from the third portion 7100. In other words, the fourth portion 7500 extends in the right-left direction from the third portion 7100. More specifically, the fourth portion 7500 extends rightward in the right-left direction from the third portion 7100. The fourth portion 7500 has a fourth length L4 in the first direction. The fourth length L4 is greater than the third length L3.

Fourth Modification

Figure 14:
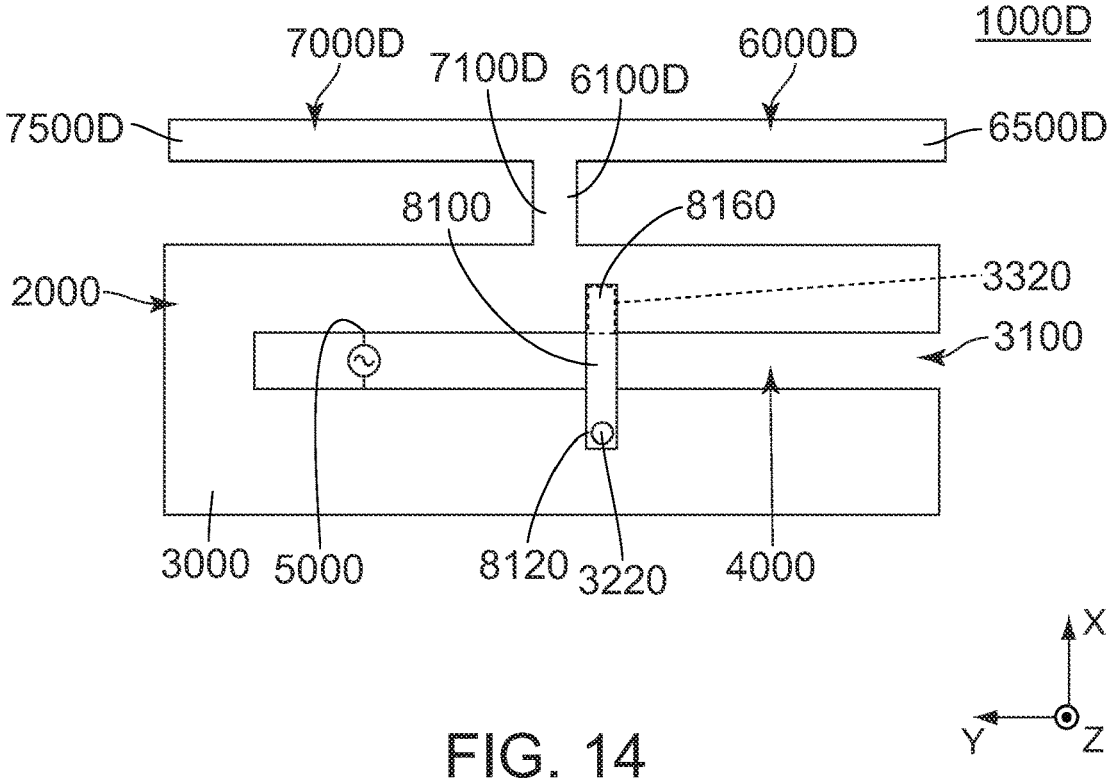
FIG. 14 is a top, schematic view showing a fourth modification of the multiband antenna of FIG. 10.

As shown in FIG. 14, a multiband antenna 1000D according to a fourth modification comprises a slot antenna 2000, a radiation element 6000D, a stub 8100 and an additional radiation element 7000D.

Referring to FIG. 14, the radiation element 6000D of the present modification is a part of a conductive layer (not shown) which is provided on a lower surface of a dielectric substrate (not shown). An electrical length of the radiation element 6000D is defined with reference to one-fourth of a wavelength of one of operating frequencies of the multiband antenna 1000D. In other words, the electrical length of the radiation element 6000D corresponds to one-fourth of a wavelength of any one of the operating frequencies of the multiband antenna 1000D. The radiation element 6000D is positioned leftward of the additional radiation element 7000D in the right-left direction. The radiation element 6000D has a first portion 6100D and a second portion 6500D.

As shown in FIG. 14, the first portion 6100D of the present modification extends from a conductive plate 3000 toward an orientation away from a slot 4000 in the second direction perpendicular to the first direction. Specifically, the first portion 6100D extends forward from the conductive plate 3000 toward an orientation away from the slot 4000 in the front-rear direction. The first portion 6100D is positioned around a middle of the multiband antenna 1000D in the first direction.

As shown in FIG. 14, the second portion 6500D of the present modification extends in the first direction from the first portion 6100D. In other words, the second portion 6500D extends in the right-left direction from the first portion 6100D. In detail, the second portion 6500D extends leftward in the right-left direction from the first portion 6100D. The second portion 6500D has a plate-like shape extending linearly in the first direction. A second length of the second portion 6500D in the first direction is greater than a first length of the first portion 6100D in the second direction.

Referring to FIG. 14, the additional radiation element 7000D of the present modification is a part of the conductive layer (not shown) which is provided on the lower surface of the dielectric substrate (not shown). An electrical length of the additional radiation element 7000D is defined with reference to one-fourth of a wavelength of one of operating frequencies of the multiband antenna 1000D. In other words, the electrical length of the additional radiation element 7000D corresponds to one-fourth of a wavelength of any one of the operating frequencies of the multiband antenna 1000D. The additional radiation element 7000D is positioned rightward of the radiation element 6000D in the right-left direction. The additional radiation element 7000D has a third portion 7100D and a fourth portion 7500D.

As shown in FIG. 14, the third portion 7100D of the present modification extends from the conductive plate 3000 toward an orientation away from the slot 4000 in the second direction. Specifically, the third portion 7100D extends forward from the conductive plate 3000 toward an orientation away from the slot 4000 in the front-rear direction. The third portion 7100D is common with the first portion 6100D.

As shown in FIG. 14, the fourth portion 7500D of the present modification extends in the first direction from the third portion 7100D. In other words, the fourth portion 7500D extends in the right-left direction from the third portion 7100D. More specifically, the fourth portion 7500D extends rightward in the right-left direction from the third portion 7100D. A fourth length of the fourth portion 7500D in the first direction is greater than a third length of the third portion 7100D in the second direction.

Referring to FIGS. 10 to 14, as compared with the conductive plate 300 of the aforementioned first embodiment, each of the conductive plate 3000 of the aforementioned embodiment and the conductive plate 3000B of the present modification has the conductive portion of reduced size around the slot 4000 to the extent that the multiband antenna 1000, 1000A, 10008, 1000C, 1000D can be resonant at the multiple frequencies. However, the present invention is not limited thereto. Specifically, the conductive plate 3000, 3000B may have a conductive portion of increased size around the slot 4000, similar to the conductive plate 300 of the first embodiment.

Although the specific explanation about the present invention is made above referring to the embodiments, the present invention is not limited thereto and is susceptible to various modifications and alternative forms. In addition, the above embodiments and variations may also be combined.

Although the multiband antenna 100, 100A, 1008, 100C, 100D, 100E, 100F, 100G, 100H, 1000, 1000A, 10008, 1000C, 1000D is composed of the single dielectric substrate 110, 1100, the present invention is not limited thereto. Specifically, the multiband antenna 100, 100A, 1008, 100C, 100D, 100E, 100F, 100G, 100H, 1000, 1000A, 1000B, 1000C, 1000D may be composed of a multilayer substrate which is formed by stacking a plurality of dielectric substrates. Alternatively, the multiband antenna 100, 100A, 1008, 100C, 100D, 100E, 100F, 100G, 100H, 1000, 1000A, 10008, 1000C, 1000D may be a discrete member which is formed by punching a metal plate.

Although each of the second portion 650, 650D, 6500, 6500A, 6500C, 6500D of the present embodiments and modifications has the plate-like shape extending linearly in the first direction, the present invention is not limited thereto. Specifically, the second portion 650, 650D, 6500, 6500A, 6500C, 6500D may have s meander shape extending in the first direction.

Figure 15:
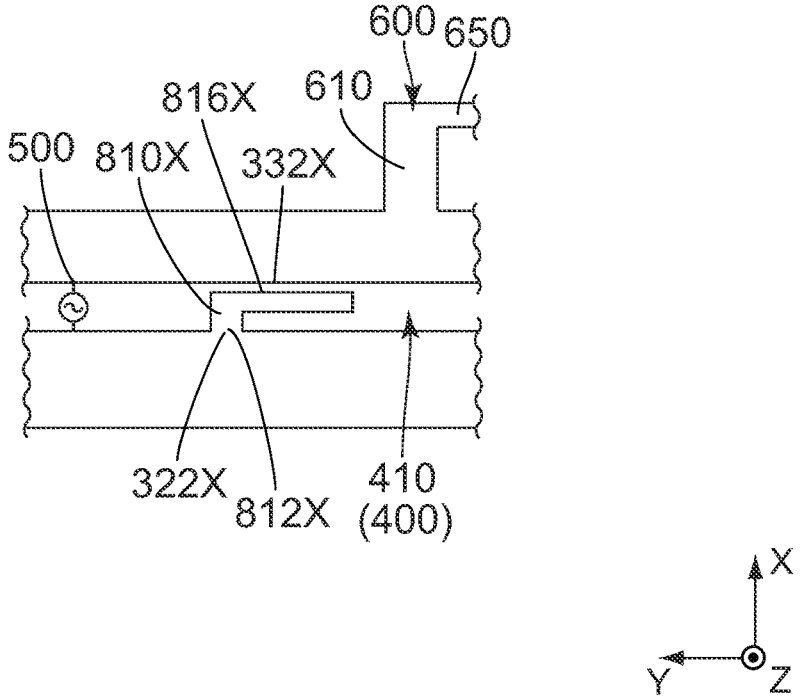
FIG. 15 is a view showing a modification of a first stub.
Figure 16:
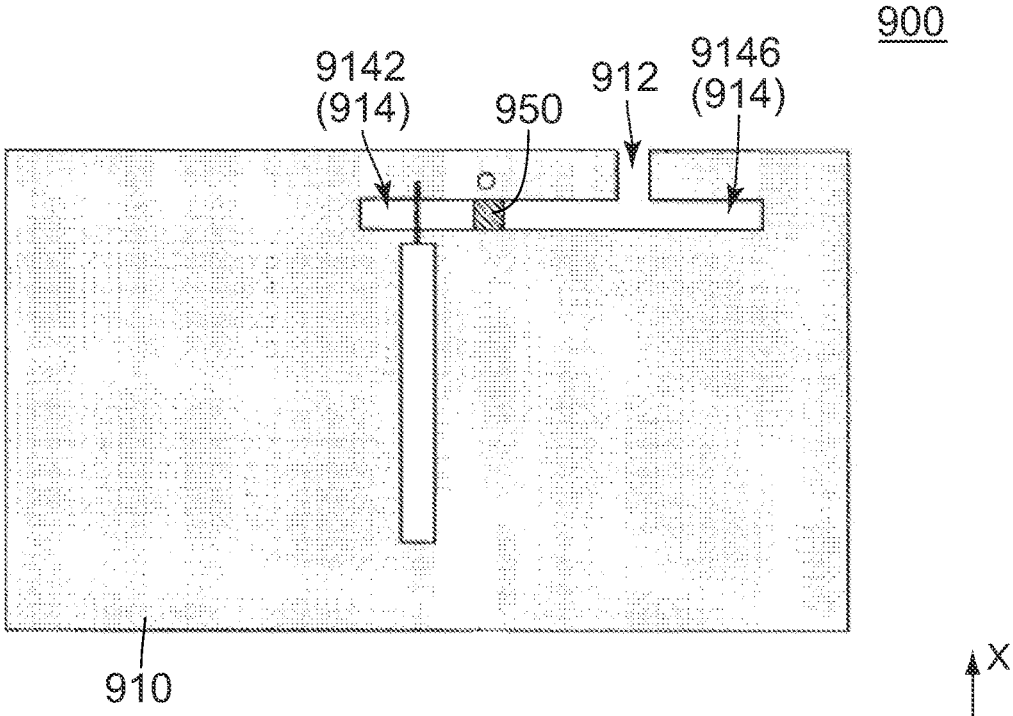
FIG. 16 PRIOR ART
FIG. 16 is a top view showing a multiband antenna of Patent Document 1.

Although the multiband antenna 100B (see FIG. 3) of the second modification of the aforementioned first embodiment comprises the first stub 810 which is the part of the conductive layer provided on the upper surface of the dielectric substrate, the present invention is not limited thereto. Referring to FIG. 15, the multiband antenna, instead of comprising the first stub 810, may comprise a first stub 810X which is a part of the conductive layer provided on the lower surface of the dielectric substrate, wherein the lower surface of the dielectric substrate is provided with the conductive plate and the radiation element 600. Specifically, the multiband antenna may be configured so that the first stub 810X and a first connecting portion 322X are provided on a common conductive layer of the dielectric substrate while a first end 812X of the first stub 810X is connected, not through the via, but directly, with the first connecting portion 322X. In addition, the first stub 8100 (see FIGS. 10 to 14) of the aforementioned second embodiment may be modified similar to the first stub 810X. Furthermore, each of the second stub 830 (see FIG. 4) of the third modification of the first embodiment and the second stub 8300 (see FIG. 12) of the second modification of the second embodiment may be modified similar to the first stub 810X.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A multiband antenna comprising a slot antenna and a radiation element, wherein:
- the slot antenna has a conductive plate;
- the conductive plate is formed with an opening portion and a slot;
- the slot partially opens through the opening portion;
- the slot extends long in a first direction;
- the radiation element has a first portion and a second portion;
- the first portion extends from the conductive plate toward an orientation away from the slot in a second direction perpendicular to the first direction;
- the first portion has a first length in the second direction;
- the second portion extends in the first direction from the first portion;
- the second portion has a second length in the first direction; and
- the second length is greater than the first length.

2. The multiband antenna as recited in claim 1, wherein:
- the opening portion connects the slot with an outside of the conductive plate in the second direction; and
- the opening portion is positioned between the radiation element and the slot in the second direction.

3. The multiband antenna as recited in claim 2, wherein the opening portion overlaps with the second portion when the multiband antenna is viewed along the second direction.

4. The multiband antenna as recited in claim 2, wherein:
- the slot includes a first slot and a second slot;
- the first slot and the second slot are positioned so that the opening portion is put between the first slot and the second slot in the first direction;
- the slot antenna comprises a feed point; and
- the feed point is connected with the conductive plate across the first slot.

5. The multiband antenna as recited in claim 4, wherein the first portion is nearer to the first slot than to the second slot.

6. The multiband antenna as recited in claim 4, wherein:
- the multiband antenna further comprises a first stub which is provided to correspond to the first slot;
- the conductive plate has a first connecting portion and a first opposed portion;
- the first connecting portion and the first opposed portion are positioned so that the first slot is put between the first connecting portion and the first opposed portion in the second direction;
- the first stub has a first end and a second end in the second direction;
- the first end of the first stub is connected with the first connecting portion; and the second end of the first stub is positioned away from the first opposed portion and faces the first opposed portion.

7. The multiband antenna as recited in claim 4, wherein:

the multiband antenna further comprises a second stub which is provided to correspond to the second slot;

the conductive plate has a second connecting portion and a second opposed portion;

the second connecting portion and the second opposed portion are positioned so that the second slot is put between the second connecting portion and the second opposed portion in the second direction;

the second stub has a first end and a second end in the second direction;

the first end of the second stub is connected with the second connecting portion; and the second end of the second stub is positioned away from the second opposed portion and faces the second opposed portion.

8. The multiband antenna as recited in claim 1, wherein:

the slot antenna comprises a feed point;

the feed point is connected with the conductive plate across the slot; and the opening portion connects the slot with an outside of the conductive plate in the first direction.

9. The multiband antenna as recited in claim 8, wherein:

the slot has a midpoint in the first direction; and the first portion is nearer to the opening portion than to the midpoint of the slot.

10. The multiband antenna as recited in claim 8, wherein:

the multiband antenna further comprises a stub;

the conductive plate has a connecting portion and an opposed portion;

the connecting portion and the opposed portion are positioned so that the slot is put between the connecting portion and the opposed portion in the second direction;

the stub has a first end and a second end in the second direction;

the first end of the stub is connected with the connecting portion; and the second end of the stub is positioned away from the opposed portion and faces the opposed portion.

11. The multiband antenna as recited in claim 1, wherein:

the multiband antenna has a plurality of operating frequencies;

the slot has a size in the second direction; and the size of the slot is not larger than one-tenth of a wavelength of any one of the operating frequencies.

12. The multiband antenna as recited in claim 1, wherein:

the multiband antenna further comprises an additional radiation element;

the additional radiation element has a third portion and a fourth portion;

the third portion extends from the conductive plate toward an orientation away from the slot in the second direction;

the third portion has a third length in the second direction;

the fourth portion extends in the first direction from the third portion;

the fourth portion has a fourth length in the first direction; and the fourth length is greater than the third length.

* * * * *